US011668065B2

(12) United States Patent
Betzer

(10) Patent No.: US 11,668,065 B2
(45) Date of Patent: Jun. 6, 2023

(54) METHOD AND APPARATUS FOR MANUFACTURING MARINE FOUNDATION

(71) Applicant: GREAT LAKES TOWERS, LLC, Monroe, MI (US)

(72) Inventor: Thomas Betzer, Grosse Pointe Park, MI (US)

(73) Assignee: VENTOWER INDUSTRIES, Monroe, MI (US)

( * ) Notice: Subject to any disclaimer, the term of this patent is extended or adjusted under 35 U.S.C. 154(b) by 367 days.

(21) Appl. No.: 15/844,343

(22) Filed: Dec. 15, 2017

(65) Prior Publication Data

US 2018/0266069 A1 Sep. 20, 2018

Related U.S. Application Data

(60) Provisional application No. 62/434,890, filed on Dec. 15, 2016.

(51) Int. Cl.

| | |
|---|---|
| ***E02D 27/18*** | (2006.01) |
| ***E02D 27/52*** | (2006.01) |
| ***E04B 1/35*** | (2006.01) |
| ***E02B 17/02*** | (2006.01) |
| *E02D 27/42* | (2006.01) |
| *E02B 17/00* | (2006.01) |

(52) U.S. Cl.
CPC ..... *E02D 27/18* (2013.01); *E02B 17/027* (2013.01); *E02D 27/525* (2013.01); (Continued)

(58) Field of Classification Search
CPC ..... B63B 21/27; E02B 17/027; E02B 2017/0039; E02B 2017/0078; (Continued)

(56) References Cited

U.S. PATENT DOCUMENTS 2,924,947 A 2/1960 Peterson
2,941,369 A 6/1960 Quinn
(Continued)

FOREIGN PATENT DOCUMENTS

FR 2426122 A1 * 12/1979 ..... E04B 1/3211
WO WO-2005038146 A1 * 4/2005 ..... E02B 17/0017

OTHER PUBLICATIONS

"Harland and Wolff", web article published by offshoreWIND.biz oat https://www.offshorewind.biz/2013/06/28/harland-and-wolff/, Jun. 28, 2013 (Ascio Technologies, Inc., Denmark).

*Primary Examiner* — Benjamin F Fiorello
*Assistant Examiner* — Stacy N Lawson
(74) *Attorney, Agent, or Firm* — Delevie Law, PLC

(57) ABSTRACT

A method and fixturing apparatus for manufacturing a suction caisson foundation includes providing an elevated center support and peripheral supports, elevating the foundation's prefabricated thumb section atop the center support, and temporarily securing radial frame members about the circumference of the prefabricated thumb section with the each frame member resting atop a respective peripheral support. The skirt panels are then affixed to the frame members, and the frame members to the prefabricated thumb section to thereby become self-supporting. The center support is removed from the interior of the resulting bucket, as by raising the peripheral supports to unload the center support, and lowering and dismantling the center support, whereupon additional panels are affixed to the frame members to define the foundation's lid, and further shaft sections added atop the prefabricated thumb section to complete the foundation. Temporary beams bridging preselected framing members advantageously allow use of transportation crawlers.

18 Claims, 5 Drawing Sheets

(52) U.S. Cl.
CPC ..... *E02B 2017/0039* (2013.01); *E02B 2017/0078* (2013.01); *E02B 2017/0091* (2013.01); *E02D 27/425* (2013.01)

(58) Field of Classification Search
CPC . E02B 2017/0091; E02D 23/00; E02D 27/52; E02D 27/525; E02D 27/18; E02D 27/425; E04B 1/3211; E04B 2001/3217; E04B 2001/3241
See application file for complete search history.

(56) References Cited

U.S. PATENT DOCUMENTS

| | | | | |
|---|---|---|---|---|
| 3,427,777 | A * | 2/1969 | Crowley | E04B 1/3211 52/745.08 |
| 4,663,898 | A * | 5/1987 | Yacaboni | E02D 27/42 52/167.1 |
| 4,720,947 | A * | 1/1988 | Yacaboni | E02D 27/42 52/167.1 |
| 5,724,775 | A * | 3/1998 | Zobel, Jr. | E04B 1/3211 359/443 |
| 6,832,455 | B1 * | 12/2004 | Tomlinson | E04B 1/20 52/259 |
| 8,734,705 | B2 * | 5/2014 | Knox | E04H 12/12 264/333 |
| 8,757,932 | B2 | 6/2014 | Beck | |
| 10,113,290 | B2 | 10/2018 | Nielsen | |
| 2011/0200399 | A1 | 8/2011 | Schakenda | |

* cited by examiner

METHOD AND APPARATUS FOR MANUFACTURING MARINE FOUNDATION

CROSS-REFERENCE TO RELATED APPLICATIONS

This application claims the benefit of U.S. Provisional Patent Application No. 62/434,890 filed on Dec. 15, 2016.

FIELD OF THE INVENTION

This invention relates to the manufacture of structural foundations, for example, suction caisson foundations with which to support off-shore wind turbines.

BACKGROUND OF THE INVENTION

Known suction caisson foundations, or suction bucket foundations 20, as shown in FIG. 1, generally include a lower portion 22 that approximates an inverted bucket, with a peripheral "skirt" 24 and upper "lid" 26 that together define an interior space that opens downwardly, and an upper "shaft" 28 mounted to the lid 26 at the shaft's base or "thumb" 30. In order to appreciate scale, and by way of example only, a proposed deployment for such foundations in Lake Erie by 2018 features a suction caisson foundation having a bucket diameter of up to 16 meters (52.5 feet), a skirt penetration depth of up to 12 meters (40 feet), a shaft height of 30 meters (99 feet), and a total outfitted weight of perhaps 450,000 kg (500 tons).

During manufacture, the skirt, lid and shaft of such known foundations are typically fabricated separately, lifted atop one another with the use of heavy cranes, and then welded together to complete the assembly. In addition to the disadvantage of requiring costly cranes, such known manufacturing methods require strict adherence to tight design tolerance to ensure that all pieces can be assembled without interferences between parts during the assembly process, thereby increasing the cost of manufacture and reducing design flexibility.

SUMMARY OF THE INVENTION

It is an object of the invention to provide a method and apparatus for manufacturing structural foundations featuring a limited use of cranes, less sensitivity to tolerance stack-ups, and greater flexibility for design modifications and design variations.

Another object of the invention is to provide a fixturing apparatus for structural foundations such as suction caisson foundations that features a center support for the foundation during manufacture that can be removed once a partially-built foundation, including its central thumb, radial frame members and skirt panels, is self-supporting.

In accordance with an aspect of the invention, a method and associated apparatus for manufacturing a suction caisson foundation includes the steps of providing an elevated center support and a plurality of peripheral supports positioned about the center support, placing a prefabricated base or central section of the foundation atop the center support, and temporarily securing a plurality of radial frame members about the circumference of the foundation's prefabricated thumb section, with a leg of each frame member resting atop and, preferably, temporarily secured to a respective peripheral support. The method and associated apparatus further includes the steps of permanently attaching at least some of the panels forming the foundation's skirt and interior chambers to the legs of the frame members, and then permanently attaching the frame members to the prefabricated thumb section of the foundation, whereby the partially-built foundation including the prefabricated thumb section, the frame members and the attached skirt panels becomes capable of supporting its own weight.

With the partially-built foundation now self-supporting, the method and associated apparatus further includes decoupling the center support from the partially-built foundation. In an exemplary method, decoupling the center support includes lowering the center support relative to the peripheral supports, preferably by slightly elevating the partially-built foundation by raising the peripheral supports, whereby the base section is unloaded from the center support, and then lowering the center support such that the center support no longer engages the partially-built foundation. In accordance with another feature of the invention, in the exemplary method, decoupling further includes removal of the center support from within the interior of the partially-built foundation.

After decoupling the center support, the method further includes the steps of permanently attaching any remaining skirt panels and the lid panels to the now-self-supporting frame members, installing shaft sections atop the prefabricated thumb section, and installing other structures, systems and features onto the foundation. Transportation crawlers are then moved beneath the skirt, and the resulting foundation is detached from and lifted off of the peripheral supports (which may themselves be removed or lowered to facilitate horizontal movement of the foundation for storage and subsequent transport).

In accordance with an aspect of the invention, in a preferred method and apparatus, the step of elevating the center support includes raising a plurality of vertical columns about the nominal axis of the center support, and lifting the center support on the vertical columns to a predetermined height relative to the peripheral supports.

In accordance with yet another aspect of the invention, the exemplary method further includes disassembly of the lowered center support to thereby permit its removal from within the interior of the partially-built foundation, for example, by passing the various components of the center support beneath the elevated skirt, or by lifting the various components through openings between the frame members. In this way, the exemplary method advantageously provides that the partially- or fully-built foundation need not be lifted up and over any elevated fixturing and, thus, obviating the need for a heavy crane.

In accordance with yet another aspect of the invention, the peripheral supports accommodate placement of a plurality of chordal supports that temporarily bridge preselected pairs of adjacent framing members proximate to the lowermost edge of the skirt. Transportation crawlers positioned beneath the foundation's skirt lift the completed foundation using the temporary chordal supports. The chordal supports may thereafter be used to facilitate storage and transport of the completed foundation, for example, to a dock where the foundation is lifted, with the chordal supports removed, onto a ship for ultimate seabed placement.

From the foregoing, it will be appreciated that, under the method and apparatus of the invention, the center support provides support for the foundation during manufacture until the partially-built foundation is self-supporting, whereupon the center support can advantageously be disassembled, preferably with its own winch system and small equipment, thereby permitting the removal of the center support from the interior of the partially-built foundation without the need of cranes while further allowing the horizontal movement of the partially- or fully-built foundation away from the build site.

And, by permanently attaching the frame members to the thumb section only after installation of at least some skirt panels on the frame members, the method of the invention advantageously avoids the deleterious tolerance stack-ups characteristic of known foundation assembly methods.

Other objects, features, and advantages of the invention will be readily appreciated upon a review of the subsequent description of the preferred embodiment and the appended claims, taken in conjunction with the accompanying Drawings.

DETAILED DESCRIPTION OF THE INVENTION

Figure 1:
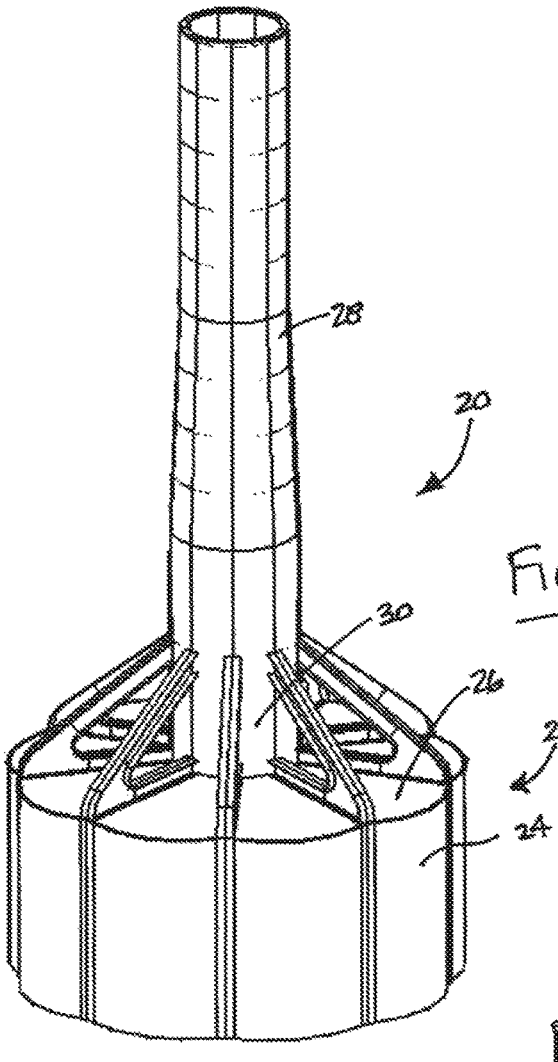
FIG. 1 PRIOR ART
FIG. 1 is an isometric view of an exemplary suction caisson foundation manufactured in accordance with an aspect of the invention.

An exemplary method and associated fixturing apparatus in accordance with the invention for manufacturing the suction caisson foundation 20 shown in FIG. 1 is hereinafter described with reference to FIGS. 2-11.

FIGS. 2-5 show an exemplary fixturing apparatus 40 including a center support 42 and a plurality of peripheral supports 45,46 disposed about the nominal central axis 48 of the center support 42 (which will likewise become the nominal central axis of the resulting foundation 20). The center support 42 is comprised of vertical columns 44 that are each mounted on a hinged base 47 and are raised and lowered into position by a winch 49 and a pulley frame 50, with the pulley frame 50 further acting as column guide as the vertical column 44 moves to its fully-raised position. The hinged base 47 advantageously permits the raising and lowering of each of the vertical columns 44 in a safe and controlled manner and in an enclosed space, without the use of cranes.

Figure 2:
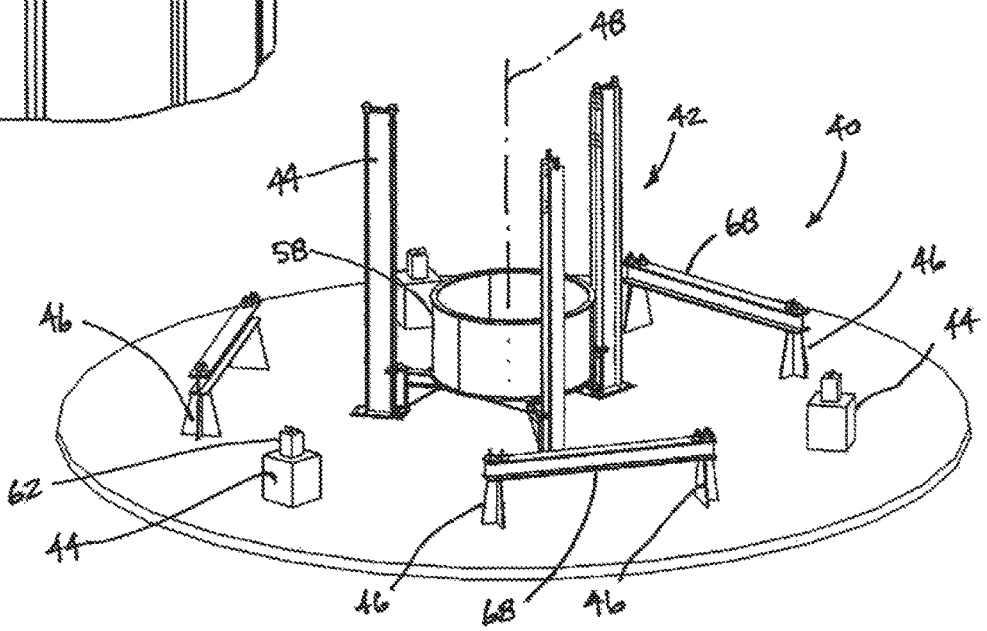
FIG. 2 is an isometric view showing various fixturing elements used in conjunction with the method of the invention to manufacture the exemplary marine foundation shown in FIG. 1, including peripheral supports and a lowered center support.
Figure 3:
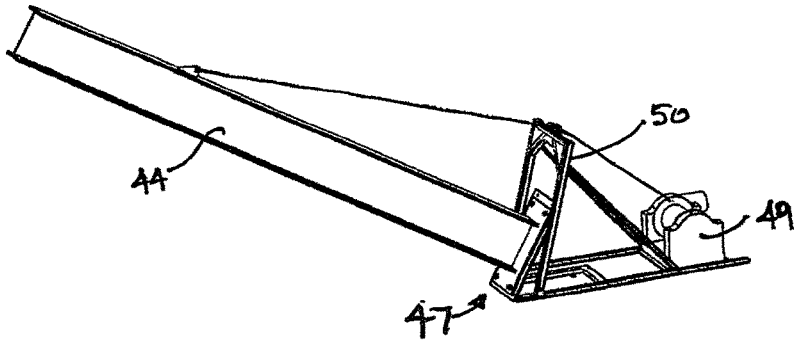
FIG. 3 is a view of hinged base used to vertically deploy each vertical column shown in FIG. 2.
Figure 4:
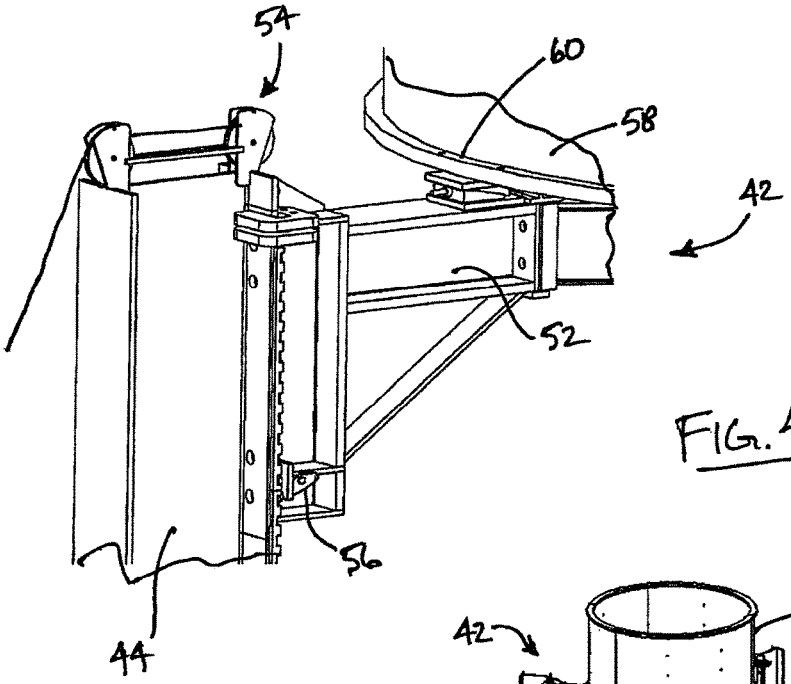
FIG. 4 is a view of the lifting mechanism employed on each vertical column to raise and maintain the center support at a predetermined height relative to the peripheral supports.
Figure 5:
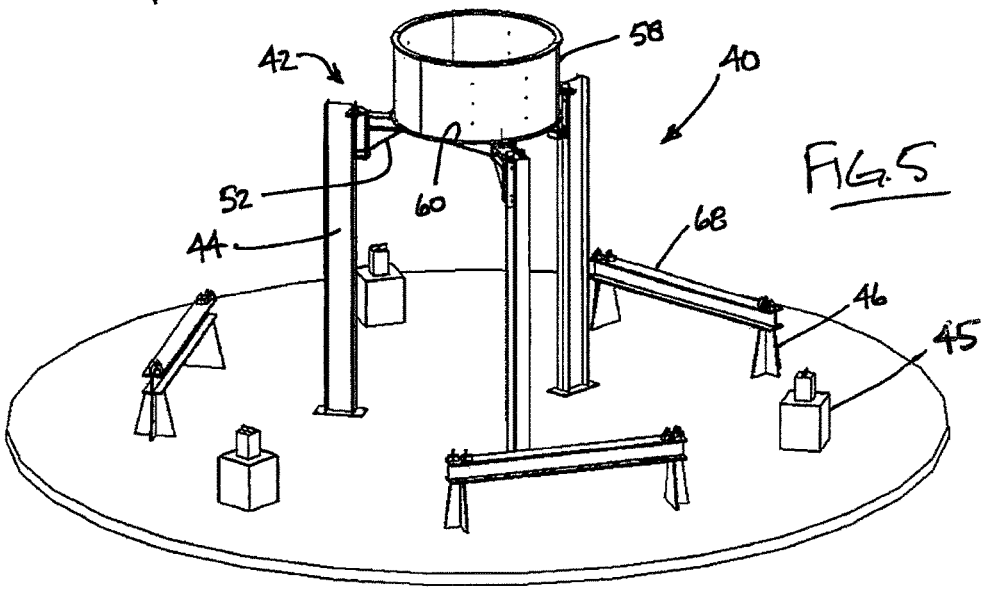
FIG. 5 is a view similar to that of FIG. 2, wherein the center support is shown in its elevated position relative to the peripheral supports, prior to placement of the annular base of foundation's shaft the atop the center support.

As best seen in FIGS. 2, 4 and 5, the center support 42 also includes a center frame 52 that is raised and maintained at a predetermined height on the vertical columns 44 through use of a cable-and-pulley system 54 and ratcheting locks 56. The cable-and-pulley system 54 advantageously permits the raising and lowering of the center frame 52 in a safe and controlled manner and in an enclosed space, without the use of cranes. It will be appreciated that a given winch 49 can be used to first erect the vertical columns 44 and thereafter lift the center frame 52 into position on the vertical columns 44.

The center frame 52 preferably features sliding or rolling interfaces to the vertical columns 44, mounting surfaces for additional components, and lift eyes enabling the raising and lowering of the center frame 52. Alternatively, the center frame 52 can house actuator systems that allow the raising and lowering of the center frame 52 without the use of winches. It will be appreciated that the center frame 52 can be single unit or can be comprised of multiple sub-components to provide flexibility for varying structure designs, or to enable ease of assembly in an enclosed space without the need for cranes.

The center frame 52 serves as structural platform for a center mount 58 when raised to the predetermined height on the vertical columns 44, while a center mount 58 serves as the interface between the center frame 52 and the foundation 20 during the latter's manufacture. The center mount 58 is removably secured atop the central frame 52 and includes support and temporary attachment features 60 complimentary to the mating surfaces and features of the foundation's thumb 30. Secondary components of the center mount 58 may include winches and associated accessories, and load relieve units (all not shown).

Figure 6:
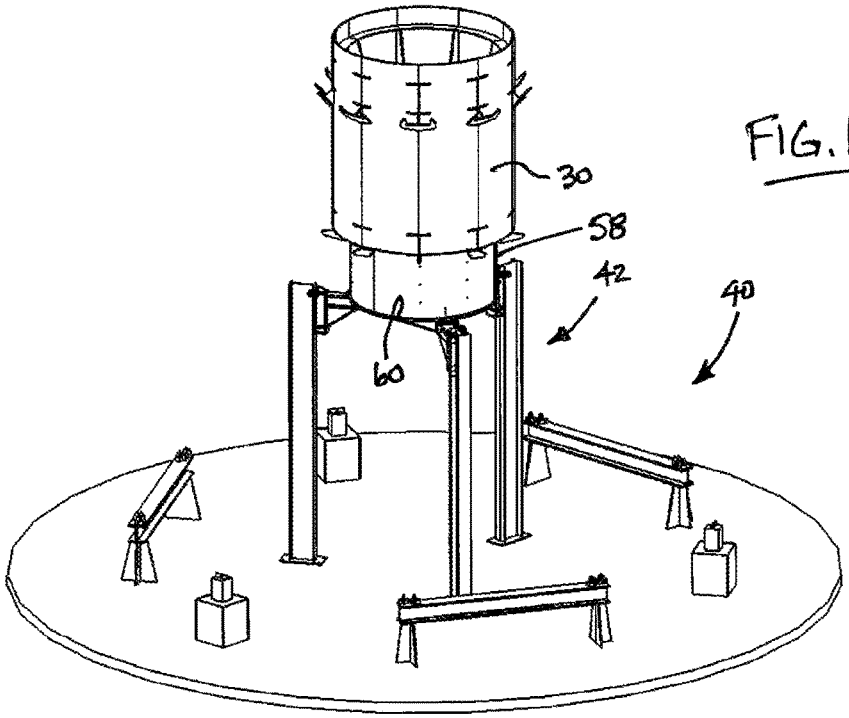
FIG. 6 is a view similar to that of FIG. 5, after placement of the shaft base atop the center support.
Figure 7:
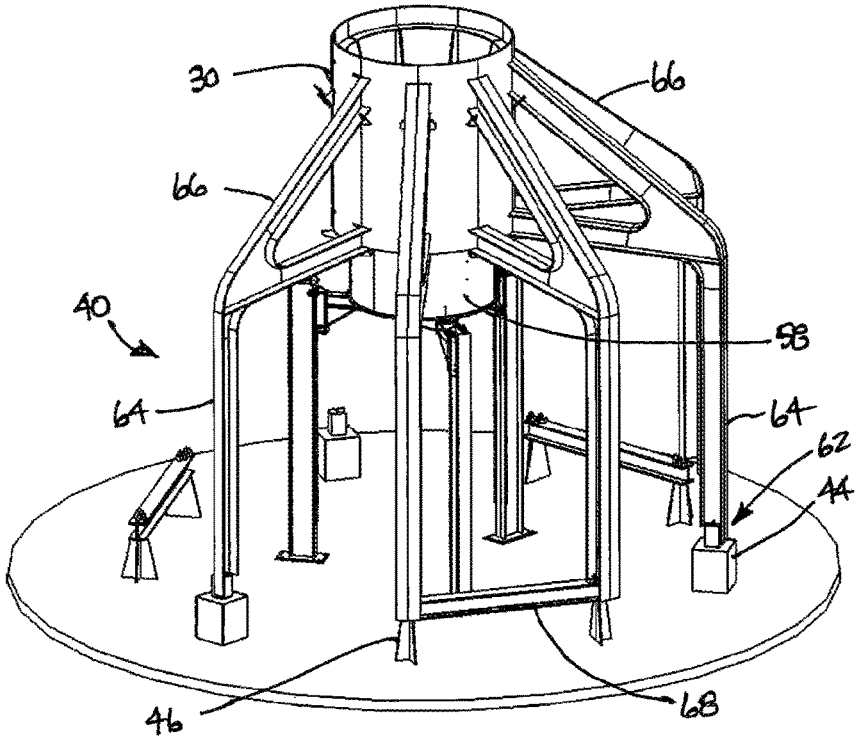
FIG. 7 is a view showing placement of radial frame members about the periphery of the prefabricated thumb, with the leg of each frame member supported by a respective peripheral support.
Figure 8:
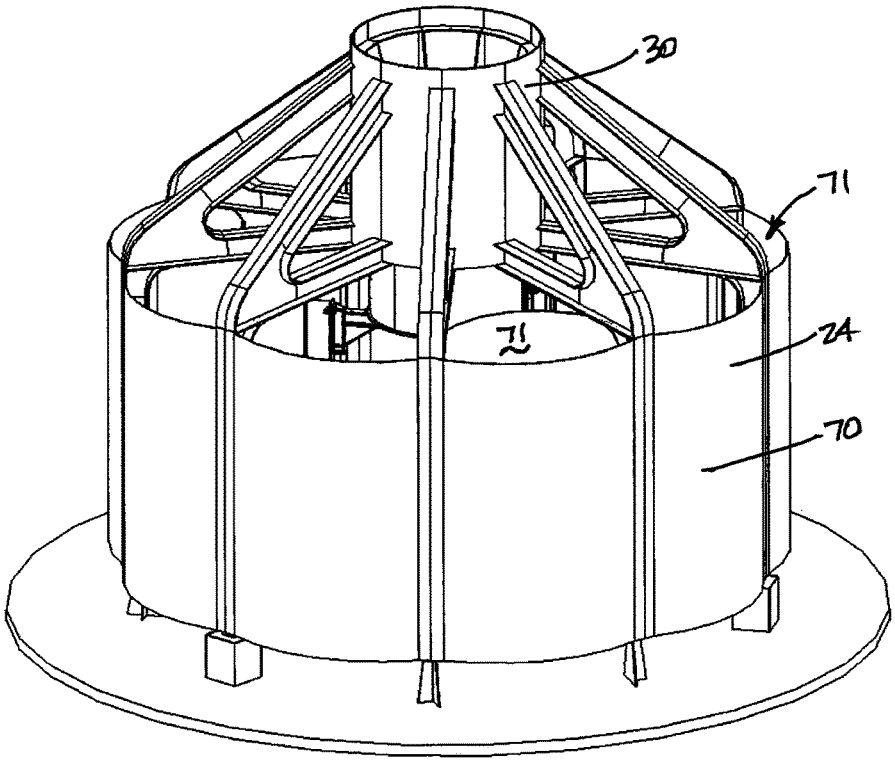
FIG. 8 is a view showing installation of the foundation's peripheral skirt panels, each bridging the respective legs of each adjacent pair of frame members, and of additional interior panels defining interior chambers within the foundation's bucket.

In the exemplary fixturing apparatus 40, and as further illustrated in FIGS. 6-8, the center mount 58 provides support for the partially-built foundation until the structure is self-supporting. It will be appreciated that the center mount 58 may comprise a single unit or be comprised of multiple pieces to enable the assembly and disassembly of the center mount 58 in an enclosed space and without the use of cranes.

As noted above and illustrated in FIG. 9, the center support 42 can advantageously be assembled/raised and lowered/disassembled with its own winch system and small equipment, thereby permitting removal of the center support 42 from the interior of the skirt of a partially-built foundation without the need of cranes, and further allowing the movement of the partially- or fully-built foundation from the build site in a horizontal direction.

Referring again to FIG. 2, the exemplary fixturing apparatus 40 includes peripheral supports 45,46 that are positioned about the nominal center axis 48 of the center support 42 along the intended periphery of the resulting foundation 20. The peripheral supports 45,46 include height adjusters 62 for adjusting the height of each peripheral support 45,46 relative to the center support 42. In accordance with another aspect of the invention, the height adjusters 62 are used to raise the resulting foundation 20 off of the peripheral supports 45,46 to thereby relieve the load between the center frame 52 and the vertical columns 44 and, thus, facilitating the disengagement of the ratcheting locks 56 at reduce loads prior to lowering the center frame 52 for disassembly.

As best seen in FIG. 7, some peripheral supports 45 directly support the leg 64 of a respective radial frame member 66, while other peripheral supports 46 are bridged by a chordal beam 68 on which adjacent frame member legs 64 are jointly supported and to which the frame member legs 64 are temporarily secured. As described more fully below, the chordal beam 68 provides a temporarily interface by which transport equipment, such as a transportation crawler, can lift the resulting foundation for horizontal movement. It will be appreciated that the single-point peripheral supports 45 are preferably re-positionable or removable to thereby provide a clear the path of movement for the transportation crawlers.

Referring now to FIGS. 5-11, the exemplary method for manufacturing the suction caisson foundation 20 includes elevating the center support 42 by raising a plurality of vertical columns 44 about a central axis 48, and lifting the center support 42 on the vertical columns 44 to a predetermined height relative to the peripheral supports 45,46. The exemplary method further includes placing the foundation's prefabricated thumb 30, which typically comprises a generally cylindrical component having a sealed floor and reinforcement structures on the inside, atop the elevated center support 42, as with a light crane; and temporarily securing a plurality of radial frame members 66 about the circumference of the foundation's prefabricated thumb 30 such that a leg 64 of each frame member 66 rests atop and, preferably, is temporarily secured to a respective peripheral support 45,46 (either directly or via a chordal beam 68). The exemplary method further includes permanently attaching the panels 70 forming the foundation's skirt 24 and interior chambers (designated by the reference numeral 71 in FIGS. 8 and 9) to the legs 64 of the frame members 66, as by welding, while the frame members 66 are otherwise temporarily secured to the thumb 30 to thereby allow slight adjustments of their position relative to each other. After the skirt panels 70 are welded to the frame members 66, the frame members 66 are themselves permanently attached to the prefabricated thumb 30, again by welding, whereby the assembled prefabricated thumb 30, skirt panels 70 and frame members 66 become self-supporting.

Figure 9:
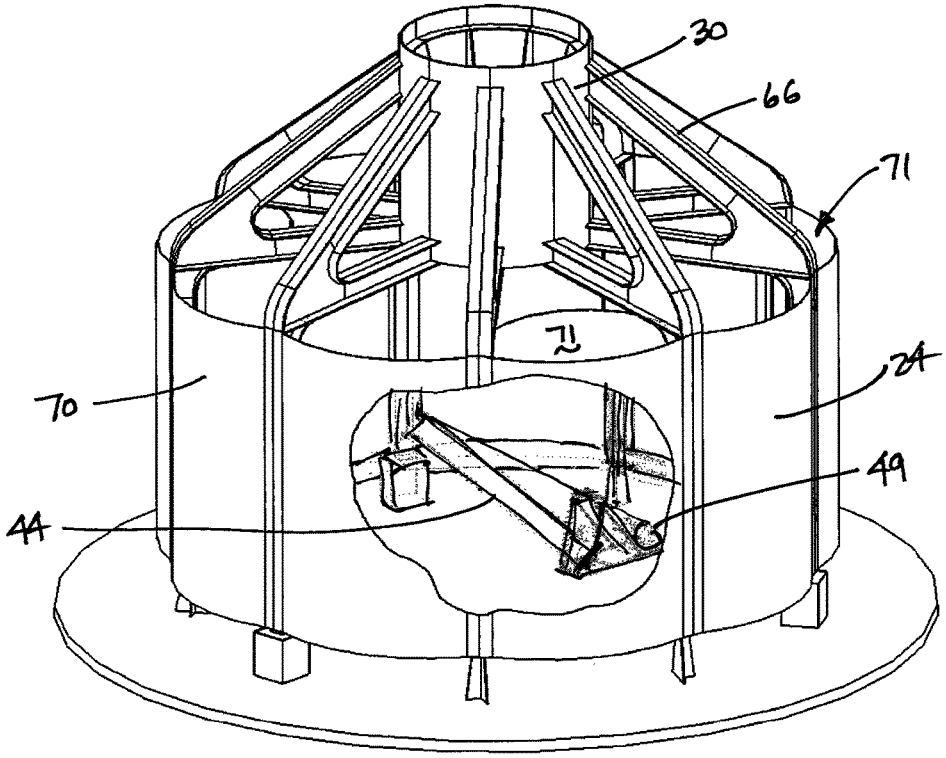
FIG. 9 is a view similar to FIG. 8, partially broken away to show the lowering of one of the center support's vertical columns after the partially-built foundation has become self-supporting.

As best illustrated in FIG. 9, after the skirt panels 70 have been permanently attached to the frame members 66, the exemplary method includes removing the center support 42 from the interior of the partially-built foundation, specifically, by slightly elevating the frame members 66 (and, hence, the attached thumb 30 and skirt panels 70) using the height adjusters on the peripheral supports 45,46, whereby the thumb 30 is unloaded from the center support 42 and release the ratcheting locks 56, and then lowering the center support 42 with the cable-and-pulley system 54. After removing and disassembling the center mount 58, and detaching the center frame 42 from the vertical columns 44, each vertical column 44 then is lowered and detached from its hinged base 47. The resulting central support components are thereafter removed from the interior of the partially-built foundation, as by passing the various components either beneath the elevated skirt or up through openings between the frame members 66.

Figure 10:
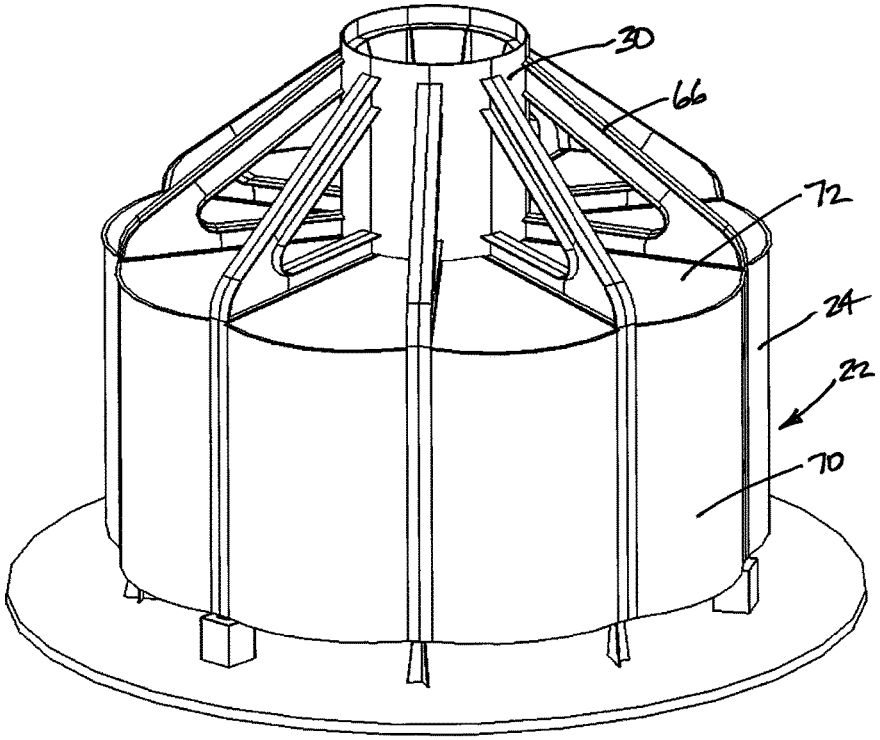
FIG. 10 is a view similar to FIG. 8, after installation of additional frame-bridging panels forming the foundation's lid.
Figure 11:
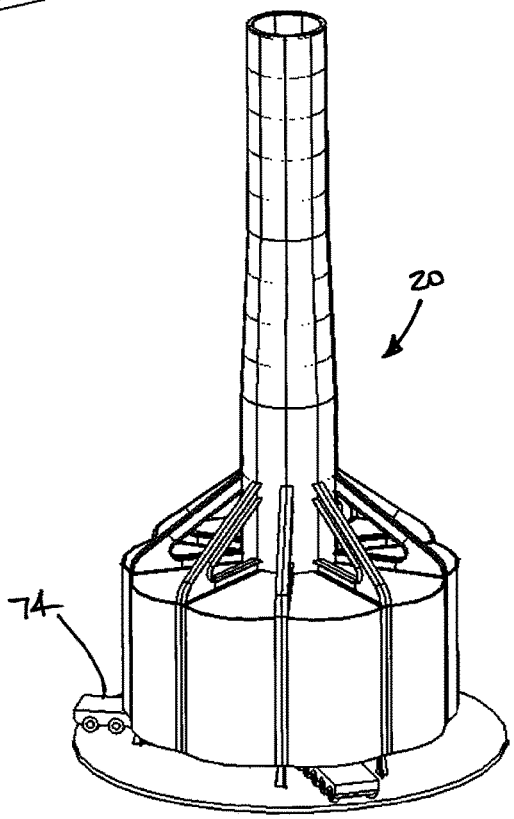
FIG. 11 is an isometric view of the completed foundation supported atop crawlers with the help of temporary chordal supports that respectively bridge designated pairs of frame members.

Referring to FIG. 10, after the center support 42 is removed, the exemplary method includes placing and permanently attaching the lid panels 72 to the generally horizontal sections of the frame members 66 to thereby seal the foundation's bucket 22, and installing sections of the shaft 28 atop the thumb 30. After secondary features are installed in the resulting foundation 20, and as best seen in FIG. 11, transportation crawlers 74 are then moved beneath the skirt at the locations of the temporary chordal beam 68, and the resulting foundation 20 is then lifted off of the peripheral supports 45,46 for horizontal movement to storage or transport.

I claim:

1. A method for manufacturing a suction caisson foundation, the method comprising:

providing a center support having a predetermined height relative to a plurality of peripheral supports positioned about the center support, wherein providing the center support at the predetermined height includes raising the center support along a nominal axis to the predetermined height;

placing a prefabricated thumb section of the foundation atop the center support;

temporarily securing a plurality of radial frame members about the circumference of the thumb section with a leg of each frame member resting atop a respective one of the peripheral supports;

permanently attaching to the legs of the frame members a first plurality of panels to partially form a skirt and define an interior of the foundation;

permanently attaching the frame members to the thumb section of the foundation such that the thumb section, frame members and attached first plurality of panels become a self-supporting intermediate structure;

decoupling the center support from the self-supporting intermediate structure, wherein decoupling the center support includes lowering the center support along the nominal axis relative to the peripheral supports; and after decoupling, permanently attaching a second plurality of panels partially forming the skirt and a third plurality of panels forming a lid to the frame members.

2. The method of claim 1, wherein raising the center support includes temporarily positioning a plurality of vertical columns about the nominal axis, and lifting the center support on the vertical columns to the predetermined height along the nominal axis.

3. The method of claim 1, wherein decoupling the center support includes raising the peripheral supports to thereby elevate the self-supporting intermediate structure relative to the center support and unload the thumb section from the center support.

4. The method of claim 1, further including removing the center support from within the interior of the self-supporting intermediate structure after decoupling.

5. The method of claim 4, wherein removing the center support includes disassembling the center support to thereby permit its removal from within the interior of the self-supporting intermediate structure.

6. The method of claim 4, wherein removing the center support includes passing the center support beneath the skirt.

7. The method of claim 4, wherein removing the center support includes passing the center support between the frame members before permanently attaching the second and third plurality of panels to the frame members.

8. The method of claim 1, further including placing a plurality of chordal supports between preselected pairs of adjacent frame members proximate to a lowermost edge of the skirt, and wherein decoupling the center support includes lifting the foundation on the chordal supports.

9. The method of claim 1, further including installing at least one shaft section atop the thumb section after decoupling the center support from the self-supporting intermediate structure.

10. A method for manufacturing a suction caisson foundation, the method comprising:

providing a center support having a predetermined height relative to a plurality of peripheral supports positioned about the center support, wherein providing the center support at the predetermined height includes raising the center support along a nominal axis to the predetermined height;

placing a prefabricated thumb section of the foundation atop the center support;

temporarily securing a plurality of radial frame members about the circumference of the thumb section with a leg of each frame member resting atop a respective one of the peripheral supports;

permanently attaching to the legs of the frame members a first plurality of panels to form a skirt and define an interior of the foundation;

permanently attaching the frame members to the thumb section of the foundation such that the thumb section, frame members and attached first plurality of panels become a self-supporting intermediate structure;

decoupling the center support from the self-supporting intermediate structure, wherein decoupling the center support includes lowering the center support along the nominal axis relative to the peripheral supports; and after decoupling, permanently attaching to the frame members a second plurality of panels forming a lid.

11. The method of claim 10, wherein raising the center support includes temporarily positioning a plurality of vertical columns about the nominal axis, and lifting the center support on the vertical columns to the predetermined height along the nominal axis.

12. The method of claim 10, wherein decoupling the center support includes raising the peripheral supports to thereby elevate the self-supporting intermediate structure relative to the center support and unload the thumb section from the center support.

13. The method of claim 10, further including removing the center support from within the interior of the self-supporting intermediate structure after decoupling.

14. The method of claim 13, wherein removing the center support includes disassembling the center support to thereby permit its removal from within the interior of the self-supporting intermediate structure.

15. The method of claim 13, wherein removing the center support includes passing the center support beneath the skirt.

16. The method of claim 13, wherein removing the center support includes passing the center support between the frame members before permanently attaching the second plurality of panels to the frame members.

17. The method of claim 10, further including placing a plurality of chordal supports between preselected pairs of adjacent frame members proximate to a lowermost edge of the skirt, and wherein decoupling the center support includes lifting the foundation on the chordal supports.

18. The method of claim 10, further including installing at least one shaft section atop the thumb section after decoupling the center support from the self-supporting intermediate structure.

* * * * *